US011527838B2

(12) United States Patent
Zhang et al.

(10) Patent No.: US 11,527,838 B2
(45) Date of Patent: Dec. 13, 2022

(54) DUAL POLARIZED ARRAY WAVEGUIDE ANTENNA

(71) Applicant: Universal Microwave Technology, Inc., Keelung (TW)

(72) Inventors: Ting-Rui Zhang, Yilan County (TW); Yu-Cheng Chen, Taipei (TW); Li-Ching Lin, Taoyuan (TW); Sheng-Feng Yeh, New Taipei (TW); You-Hua Wu, Hsinchu (TW); Tung-Yi Wu, Keelung (TW)

( * ) Notice: Subject to any disclaimer, the term of this patent is extended or adjusted under 35 U.S.C. 154(b) by 186 days.

(21) Appl. No.: 17/138,932

(22) Filed: Dec. 31, 2020

(65) Prior Publication Data

US 2022/0209425 A1 Jun. 30, 2022

(51) Int. Cl.

| | |
|---|---|
| ***H01Q 21/06*** | (2006.01) |
| ***H01Q 1/02*** | (2006.01) |
| ***H01Q 25/00*** | (2006.01) |
| ***H01Q 23/00*** | (2006.01) |
| ***H01Q 21/24*** | (2006.01) |

(52) U.S. Cl.

CPC ..... *H01Q 21/24* (2013.01); *H01Q 1/02* (2013.01); *H01Q 21/065* (2013.01); *H01Q 23/00* (2013.01); *H01Q 25/001* (2013.01)

(58) Field of Classification Search

CPC ..... H01Q 1/02; H01Q 13/08; H01Q 13/085; H01Q 19/136; H01Q 21/064; H01Q 21/065; H01Q 21/24; H01Q 23/00; H01Q 25/001

See application file for complete search history.

(56) References Cited

U.S. PATENT DOCUMENTS

2015/0162668 A1* 6/2015 Oppenlaender .... H01Q 21/0025 343/776
2022/0094032 A1* 3/2022 Delen, IV ..... H01Q 13/06

* cited by examiner

*Primary Examiner* — Robert Karacsony

(57) ABSTRACT

The present invention discloses a new dual polarized array waveguide antenna configured above a signal processing substrate and sequentially including an antenna array substrate, a coupling substrate and a waveguide body. The antenna array substrate includes a plurality of patches, each of which having a first coupling portion and a second coupling portion coupled to the signal processing substrate. The top surface of the coupling substrate includes a plurality of coupling pads corresponding to the patches, and each coupling pad is configured above an intersection area of the first coupling portion and the second coupling portion. The waveguide body includes a plurality of waveguide channels passing through the waveguide body and corresponding to the coupling pads. Each waveguide channel has a first ridge pair and a second ridge pair projecting from wall surfaces. Each of the first ridge pair and the second ridge pair has a tapered opening portion withdrawn toward the wall surface of the waveguide channel on an upper section of the waveguide channel. Accordingly, signal transmission quality is improved by the structural arrangement above.

12 Claims, 6 Drawing Sheets

DUAL POLARIZED ARRAY WAVEGUIDE ANTENNA

BACKGROUND OF THE INVENTION

Field of the Invention

The present invention relates to an array antenna having a waveguide, and more particularly to a new dual polarized array waveguide antenna.

Description of the Prior Art

Antennas are an important device in wireless communication equipment. Antennas allow signals to be converted into electromagnetic energy released into free space, and are also capable of receiving electromagnetic waves from free space.

In current mobile communication technologies, demands for transmission rates and bandwidths are constantly increasing, such that carrier wavelengths used by mobile communication technologies have entered short wavebands with sufficient bandwidths. For example, transmission techniques of the 5th Generation (5G) Mobile Networks use millimeter waves with a frequency exceeding 6 GHz, and may even proceed to use of millimeter waves of 26.5 GHz to 300 GHz.

However, as the wavelength of a carrier gets shorter, the attenuation level of electromagnetic wave energy becomes faster as the transmission distance in air increases. Thus, a deployment that uses an antenna array is adopted for configuring an antenna device so as to centralize the energy of electromagnetic waves. In an antenna array, the distance between individual antenna units needs to be less than or equal to the length of half wavelength of carriers used, in a way that these antenna are necessarily closely arranged, leading extreme difficulties in further enhancing signal transmission quality.

SUMMARY OF THE INVENTION

It is an object of the present invention to enhance signal transmission quality.

It is another object of the present invention to provide an array waveguide antenna with low transmission loss in transmission of short-wavelength carriers.

It is another object of the present invention to provide an array waveguide antenna with better impedance matching and improved bandwidths.

It is yet another object of the present invention to provide an array waveguide antenna with a better heat dissipation ability.

To achieve the above and other objects, a new dual polarized array waveguide antenna is disclosed according to an embodiment of the present invention. The new dual polarized array waveguide antenna is configured above a signal processing substrate, and includes an antenna array substrate, a coupling substrate and a waveguide body. The antenna array substrate includes a plurality of patches, each of which having a first coupling portion and a second coupling portion coupled to the signal processing substrate. The first coupling portion is for transmitting a first electromagnetic signal, and the second coupling portion is for transmitting a second electromagnetic signal, wherein polarization directions of the first electromagnetic signal and the second electromagnetic signal are orthogonal. The coupling substrate is configured above the antenna array substrate, a top surface of the coupling substrate includes a plurality of coupling pads corresponding to the patches, and each of the coupling pads is configured above an intersection area of the first coupling portion and the second coupling portion. The waveguide body is configured above the coupling substrate, and includes a plurality of waveguide channels passing through the waveguide body and corresponding to the coupling pads. Each of the waveguide channels has a first ridge pair and a second ridge pair projecting from wall surfaces. Each of the first ridge pair and the second ridge pair has two ridges arranged opposite to each other. The first ridge pair transmits the first electromagnetic signal, and the second ridge pair transmits the second electromagnetic signal. On an upper section of the waveguide channel, each of the first ridge pair and the second ridge pair has an opening portion withdrawn toward the wall surface of the waveguide channel.

According to an embodiment of the present invention, each of the first ridge pair and the second ridge pair may have a tapered front edge portion on a portion other than the opening portion.

According to an embodiment of the present invention, an axis of the waveguide channel may pass through the coupling pad.

According to an embodiment of the present invention, a vertical depth of the opening portion may be less than ⅓ of a vertical depth of the waveguide channel.

According to an embodiment of the present invention, the opening portion may have a step portion near an exit of the waveguide channel, and a vertical depth of the step portion is less than 1/20 of the vertical depth of the opening portion.

According to an embodiment of the present invention, the coupling pad may be a rectangle in shape and comprises a metal material.

According to an embodiment of the present invention, the coupling pad may be a square in shape and comprises a metal material.

According to an embodiment of the present invention, the patch may be an asymmetric cross and comprises a metal material.

According to an embodiment of the present invention, an area of the coupling pad may be less than an area of the intersection area of the first coupling portion and the second coupling portion.

According to an embodiment of the present invention, the coupling substrate may comprise thereon a heat dissipation lattice layer, the heat dissipation lattice layer is coupled to a plurality of heat conducting units passing through the coupling substrate and the antenna array substrate, and each of the heat conducting units is coupled to a grounding layer of the signal processing substrate.

According to an embodiment of the present invention, each of the coupling pads may be surrounded by the heat dissipation lattice layer.

According to an embodiment of the present invention, each of the waveguide body, the heat dissipation lattice layer and the heat conducting units may comprise a metal material.

Thus, on the basis of the structural arrangement of the waveguide body and the coordination of the antenna array substrate, the new dual polarized array waveguide antenna disclosed according to the embodiments of the present invention provides better waveguide matching, reduces transmission loss, facilitates electromagnetic wave energy to be fed from the antenna substrate into the waveguide body and be emitted from the waveguide body, further helping to increase the bandwidth and providing better beamforming effects. Moreover, by using a heat dissipation lattice layer and a plurality of heat conducting units, the antenna array in a dense arrangement is provided with a better heat dissipation solution.

DESCRIPTION OF THE PREFERRED EMBODIMENTS

The technical characteristics, contents, advantages and effects of the present invention will become apparent from the following detailed description taken with the accompanying drawing.

For energy of electromagnetic waves emitted from an array antenna, the beamforming effect of the electromagnetic waves can be further achieved using a waveguide structure. However, the waveguide structure needs to be correspondingly reduced when the wavelength of the transmitted electromagnetic waves gets shorter, such that a feed structure between the waveguide structure and the array antenna becomes extremely critical.

A waveguide antenna described in the embodiments below achieves waveguide matching with an antenna array substrate using a structural arrangement of ridge pairs of a waveguide body and a configuration of a coupling substrate, further allowing waveguide energy to be smoothly emitted. Moreover, a distance used between waveguide channels may also be further shortened (e.g., shorter than 5 mm), while achieving better beamforming effects and increased bandwidths.

Figure 1:
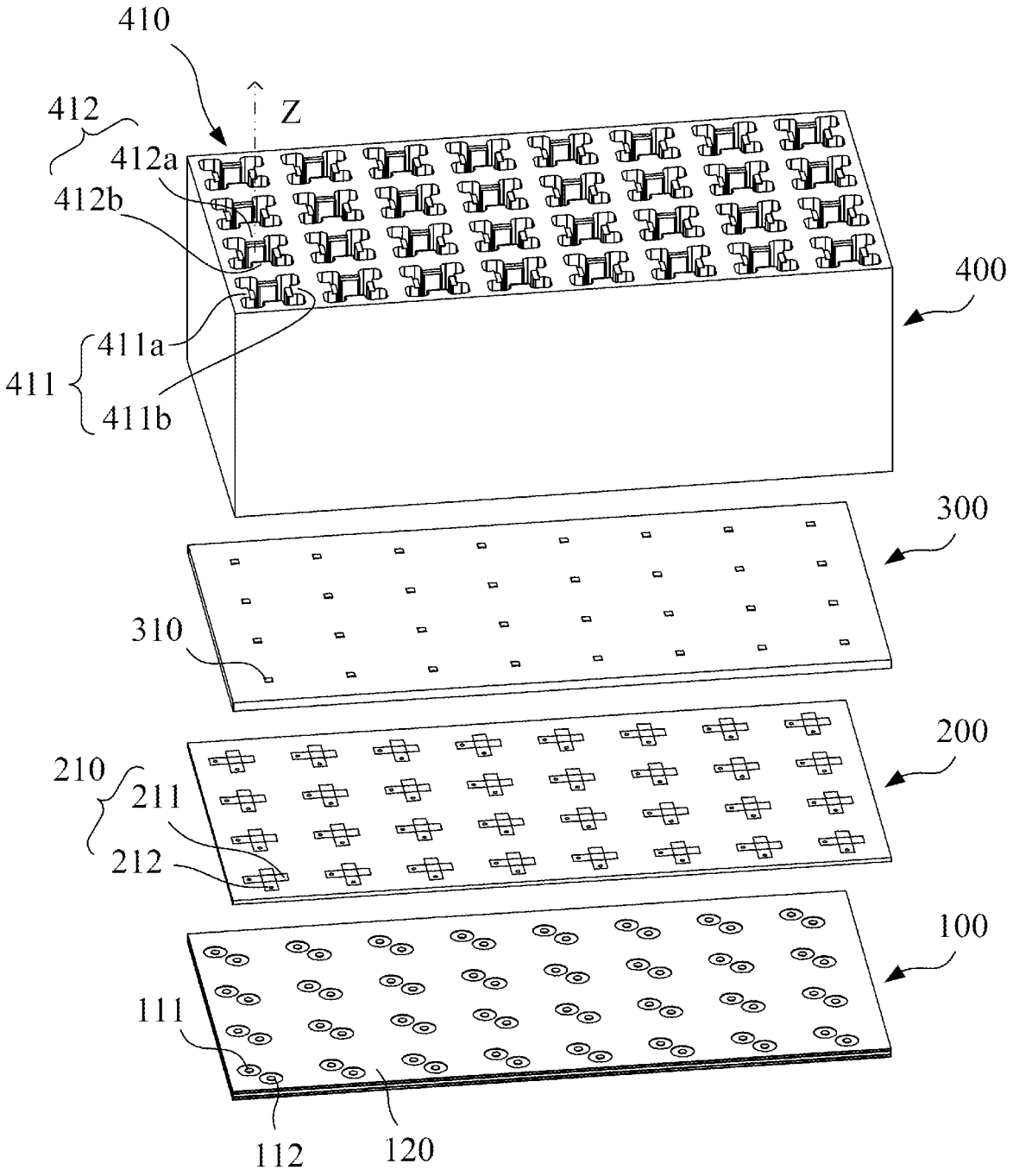
FIG. 1 is an exploded schematic diagram of a new dual polarized array waveguide antenna and a signal processing substrate according to an embodiment of the present invention.

FIG. 1 shows an exploded schematic diagram of a new dual polarized array waveguide antenna and a signal processing substrate according to an embodiment of the present invention. The new dual polarized array waveguide antenna includes an antenna array substrate 200, a coupling substrate 300 and a waveguide body 400. The new dual polarized array waveguide antenna is configured above a signal processing substrate 100. It should be noted that, another layer may be or may be not configured between the new dual polarized array waveguide antenna and the signal processing substrate 100, between the antenna array substrate 200 and the coupling substrate 300, or between the coupling substrate 300 and the waveguide body 400; in this embodiment, an example without other layers in between is described.

The antenna array substrate 200 of the new dual polarized array waveguide antenna is capable of feeding, via patches 210 and the coupling substrate 300, signals transmitted from the signal processing substrate 100 to waveguide channels 410 of the waveguide body 400, and further emitting the electromagnetic wave energy into the air via the waveguide channels 410. FIG. 1 depicts an example of a 4×8 antenna array. The top surface of the coupling substrate 300 configured above the antenna array substrate 200 includes a plurality of coupling pads 310 corresponding to the patches 210, and the waveguide body 400 is provided with waveguide channels 410 in a number corresponding to the coupling pads 310.

Each of the patches 210 has a first coupling portion 211 and a second coupling portion 212. The first coupling portion 211 may be coupled to a first signal point 111 of the signal processing substrate 100, and the second coupling portion 212 may be coupled to a second signal point 112 of the signal processing substrate 100. For example, the antenna array substrate 200, the signal processing substrate 100 and the coupling substrate 300 may individually be printed circuit boards (PCB); in these substrates, coupling requirements of various circuit signals and grounding points may be achieved by means of a layered structure, thus forming various transmission paths in the layered structure. Below the signal processing substrate 100, an integrated circuit (IC) may be configured to perform tasks including packet processing and conversion, and to establish the transmission paths using the layered structure and arrangement of conduction paths so as to further transmit signals to corresponding signal points.

Thus, each coupling portion may complete a coupling path by means of the manufacturing process of the layered structure of the printed circuit boards; for example, a conductive column is formed in a via passing through the antenna array substrate 200 to achieve coupling between a coupling point and a signal point. The first signal point 111 transmits a first electromagnetic signal, and the second signal point 112 transmits a second electromagnetic signal. Polarization directions of the first electromagnetic signal and the second electromagnetic signal are orthogonal so as to achieve dual-signal transmission performance.

The coupling substrate 300 is configured above the antenna array substrate 200. The top surface of the coupling substrate 300 includes a plurality of coupling pads 310 corresponding to the patches 210. Each coupling pad 310 is configured above an intersection area of the first coupling portion 211 and the second coupling portion 212, with associated details to be described with reference to FIG. 4 shortly. Between the coupling pad 310 and the corresponding patch 210, two signals having orthogonal polarization directions of electric fields can be coupled, allowing the signals to be smoothly transmitted regardless of whether a single signal or dual signals are used.

The waveguide body 400 is configured above the coupling substrate 300, and includes a plurality of waveguide channels 410 passing through the waveguide body 400 and corresponding to the coupling pads 310. Each waveguide channel 410 has a first ridge pair 411 and a second ridge pair 412 projecting from wall surfaces. The first ridge pair 411 has two ridges arrange opposite to each other, including a first portion 411*a* and a second portion 411*b*. The second ridge pair 412 similarly has two ridges arranged opposite to each other, including a first portion 412*a* and a second portion 412*b*. The direction in which the first ridge pair 411 projects from the wall surface of the waveguide channel 410 may correspond to the polarization direction of the first electromagnetic signal. The direction in which the second ridge pair 412 projects from the wall surface of the waveguide channel 410 may corresponding to the polarization direction of the second electromagnetic signal. Accordingly, the first ridge pair 411 transmits the first electromagnetic signal, and the second ridge pair 412 transmits the second electromagnetic signal.

The antenna array substrate 200 is frequently used as a transmission interface for emitting electromagnetic wave energy into the air. However, in the embodiment of the present invention, by using the ridge structure in the waveguide body 400 and the arrangement of the coupling substrate 300, waveguide matching is enhanced while transmission loss is reduced, further increasing bandwidths and providing better beamforming effects. The waveguide body 300 may be formed of a metal material or include a metal material, and effectively achieves a heat dissipation effect for the entire antenna device through the heat conductivity of the metal material.

Figure 2:
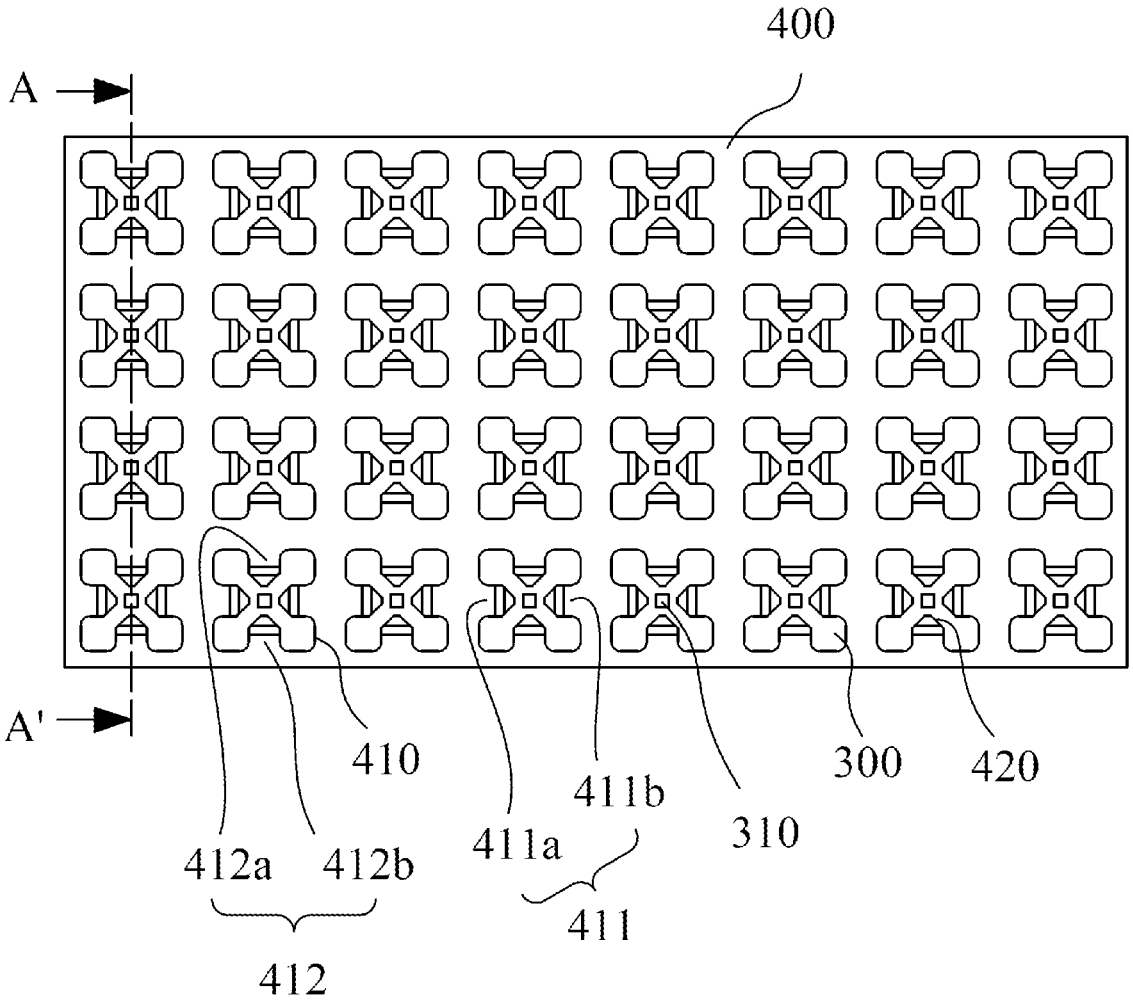
FIG. 2 is a schematic diagram in a top view of FIG. 1.

Referring to FIG. 1 and FIG. 2, FIG. 2 shows a schematic diagram in a top view of FIG. 1. The main shape of the waveguide channel 410 is a rectangle in shape in this embodiment, and channels in other shapes are also applicable. After forming the first ridge pair 411 and the second ridge pair 412, a channel region of the waveguide channel 410 is formed as being similar to an X in shape as shown in FIG. 2, wherein the center part of the X is the coupling pad 310 and the axis (as exemplified by a Z in FIG. 1) of the waveguide channel 410 may be configured to pass through the coupling pad 310. Further, observing from FIG. 2, each of the first ridge pair 411 and the second ridge pair 412 includes a tapered front edge portion 412 at a part close to the axis of the waveguide channel 410. Each of the parts 411*a*, 411*b*, 412*a* and 412*b* of the two ridge pairs 411 and 412 has the front edge portion 420. On a cross section, the front edge portion 420 displays a shape such as a triangle or a trapezoid featuring a tapered front edge.

Figure 3:
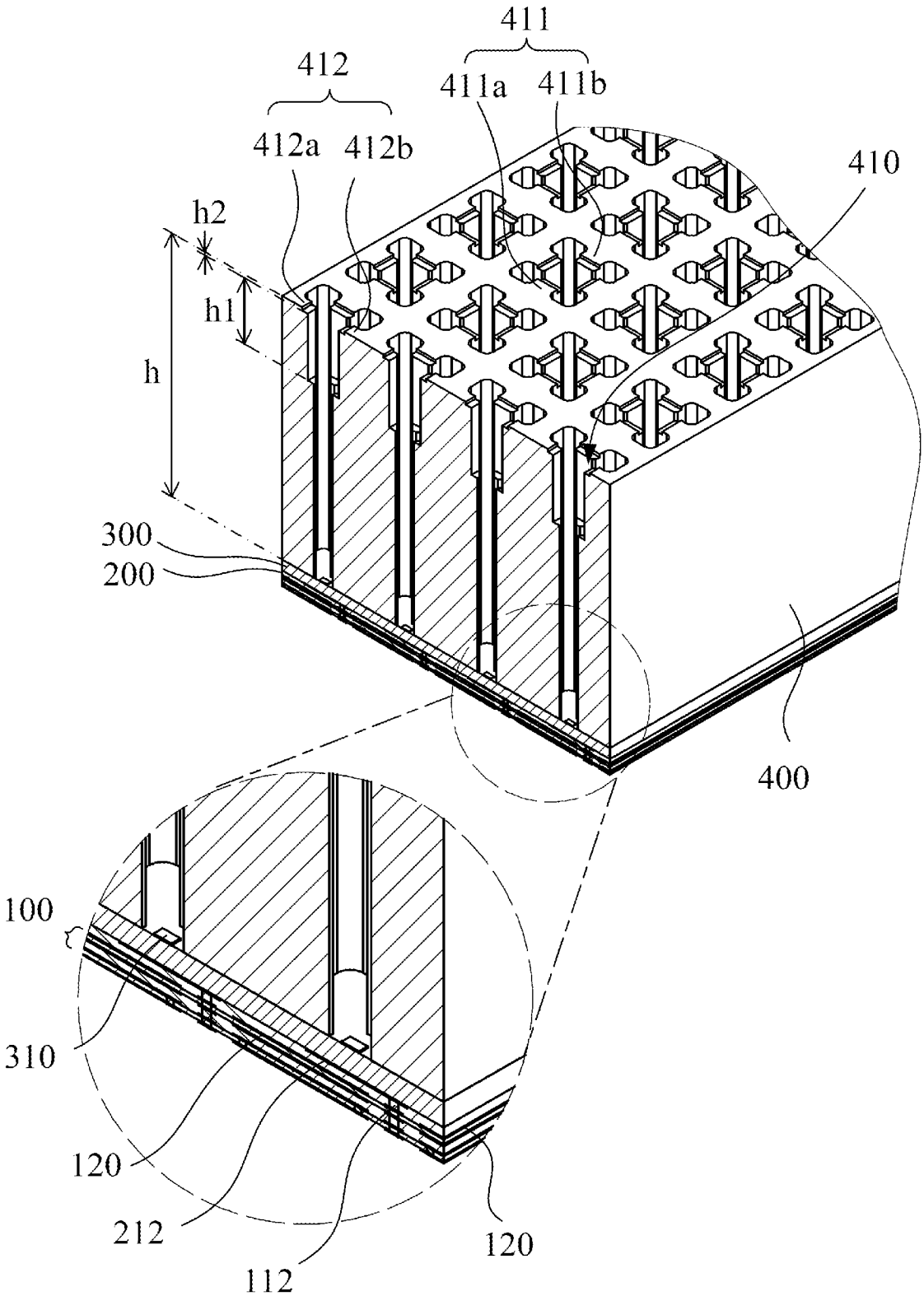
FIG. 3 is a partial three-dimensional section schematic diagram along a section line AA' in FIG. 2.

Referring to FIG. 1, FIG. 2 and FIG. 3, FIG. 3 shows a partial three-dimensional section schematic diagram along a section line AA' in FIG. 2. On an upper section of the waveguide channel 410, each of the two ridge pairs 411 and 412 has an opening portion (as exemplified by parts respectively having vertical depths h1 and h2 in FIG. 3) withdrawn toward the wall surface of the waveguide channel 410. Regarding the expression of FIG. 3, a cross section of the second ridge pair 412 is depicted, wherein the first ridge pair 411 has a structure identical to that of the second ridge pair 412, and so only the second ridge pair 412 is indicated in FIG. 3. For transmission of signals in millimeter waves, better signal transmission is provided when the vertical depth of the opening portion is less than ⅓ of the vertical depth of the waveguide channel 410, that is, when $(h1+h2)<(1/3)h$ is satisfied. Moreover, even better transmission effects are provided when $(h1+h2)$ is equal to $(1/4)h$, wherein the range of $(h1+h2)$ is ±5% of $(1/4)h$.

In addition, the opening portion close to the exit of the waveguide channel 410 may further have a step portion (as exemplified by a part having a vertical depth of h1 in FIG. 3). The vertical depth of the step portion is less than 1/20 of the vertical depth of the opening portion, that is, $h2<(1/20)(h1+h2)$. The number of the step portion is one as an example in FIG. 3, and other number of steps are also applicable. In the example shown in FIG. 1, a grounding layer 120 on a surface of the signal processing substrate 100 is also correspondingly represented in FIG. 3.

Figure 4:
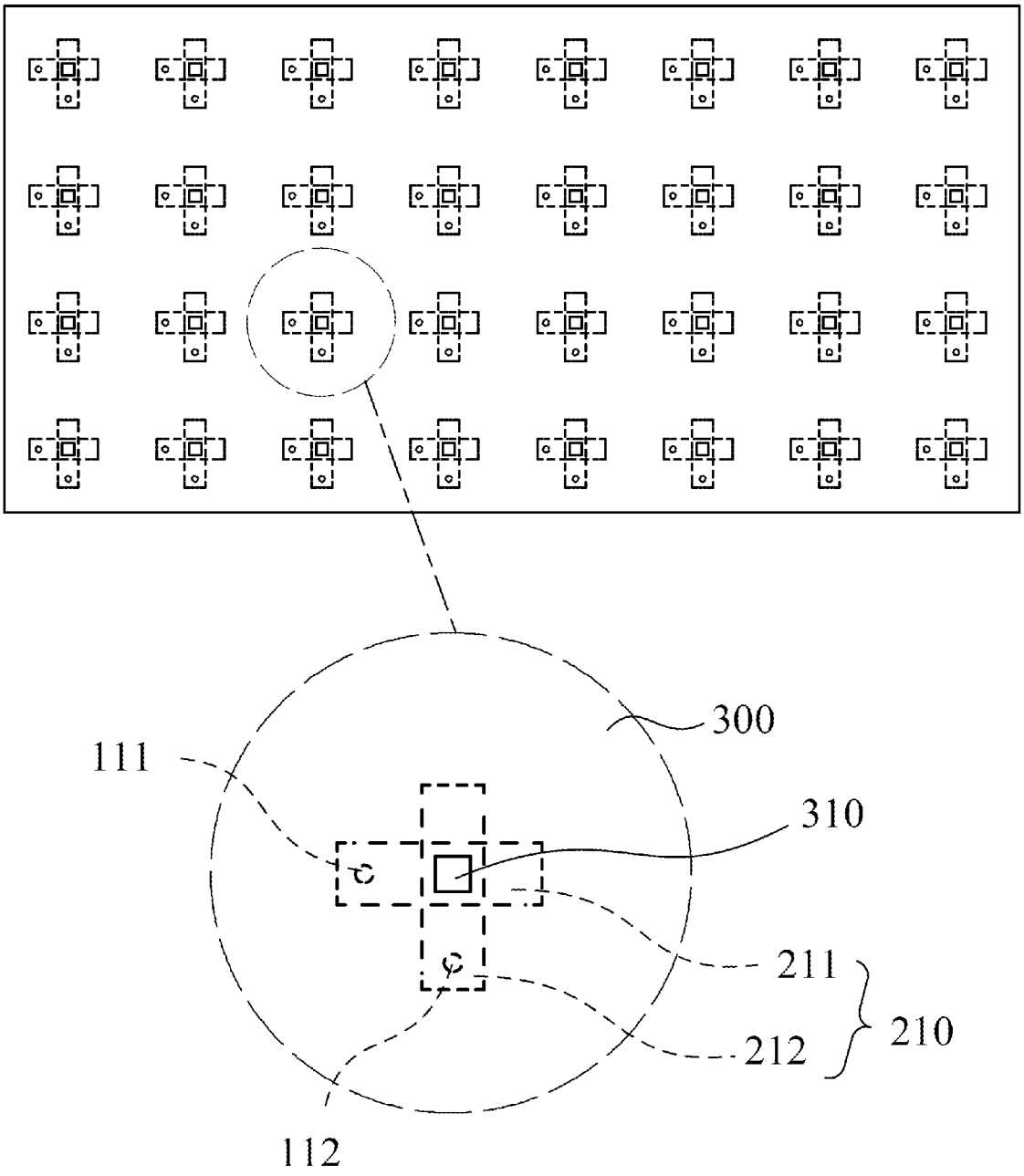
FIG. 4 is a top schematic diagram of one single coupling pad and a peripheral region thereof on a coupling substrate.

Referring to FIG. 3 and FIG. 4, FIG. 4 shows a top schematic diagram of a single coupling pad and a peripheral region thereof on a coupling substrate. The coupling substrate 300 has the coupling pad 310, and below the coupling substrate 300 is the antenna array substrate 200. From FIG. 4, the position relationship in the vertical space of the coupling pad 310 and the patch 210 (including the first coupling portion 211 and the second coupling portion 212) can be understood. Meanwhile, it can also be further understood based on FIG. 4 that, the coupling pad 310 is configured above a region above the intersection area of the first coupling portion 211 and the second coupling portion 212. Moreover, the area of the coupling pad 310 may be configured to be less than the area of the intersection area of the first coupling portion 211 and the second coupling 212 (as exemplified by the pattern shown in FIG. 4). As shown in FIG. 4, corresponding regions of the first coupling portion 211 and the second coupling portion 212 are both exemplified by rectangles.

The shape of the plate of the coupling pad 310 may be a rectangle, and preferably, a square with symmetry. The shape of the patch 210 may be an asymmetric cross, and the cross includes extension portions (referring to FIG. 1) that respectively correspond to the first signal point 111 and the second signal point 112 of the signal processing substrate 100 and extend from two end portions of the cross, accordingly providing signals with better coupling effects. In addition, the coupling pad 310 and the patch 210 may be plates formed of metal bodies or bodies containing metal materials.

Figure 5:
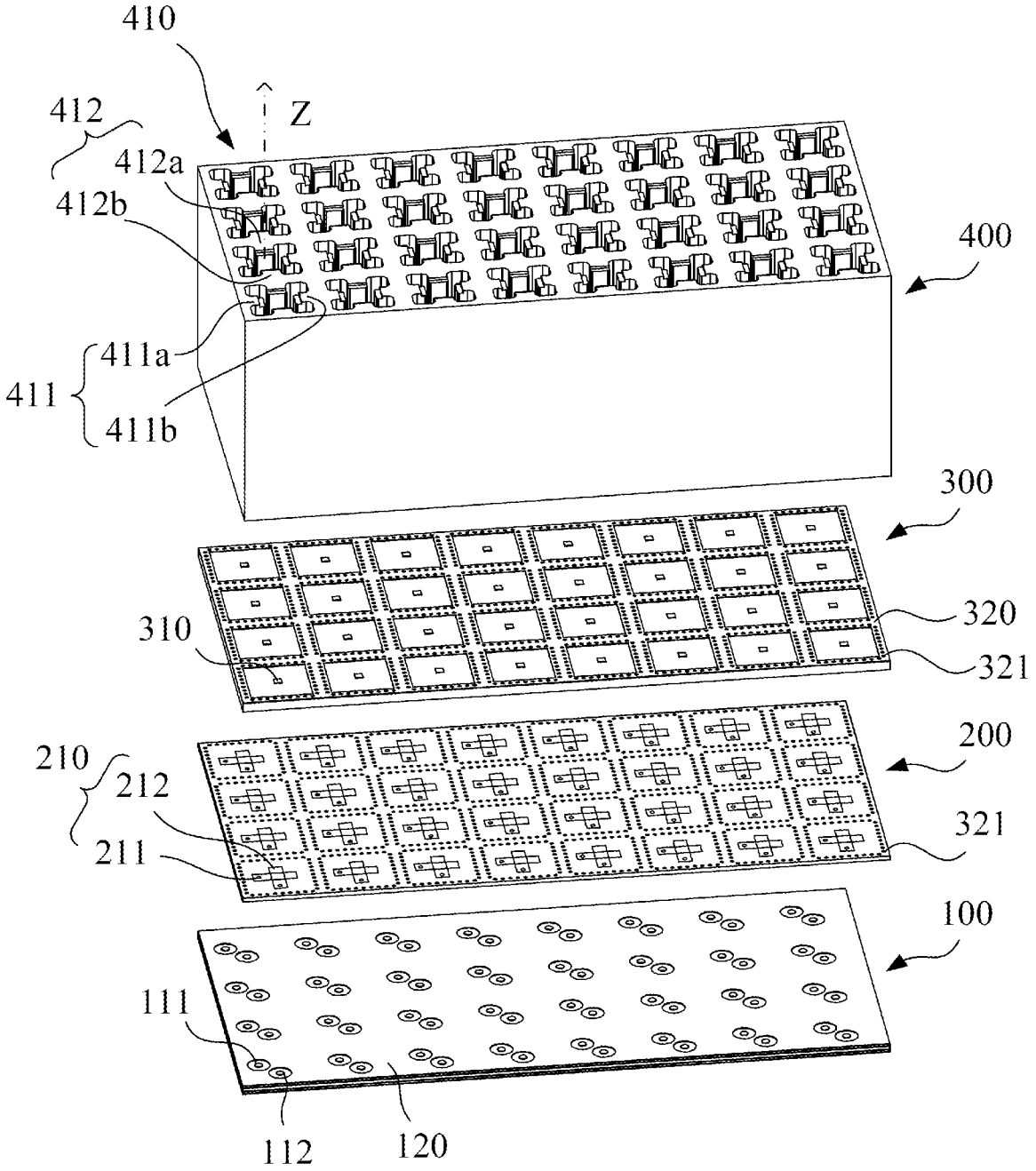
FIG. 5 is an exploded schematic diagram of a new dual polarized array waveguide antenna and a signal processing substrate according to another embodiment of the present invention.
Figure 6:
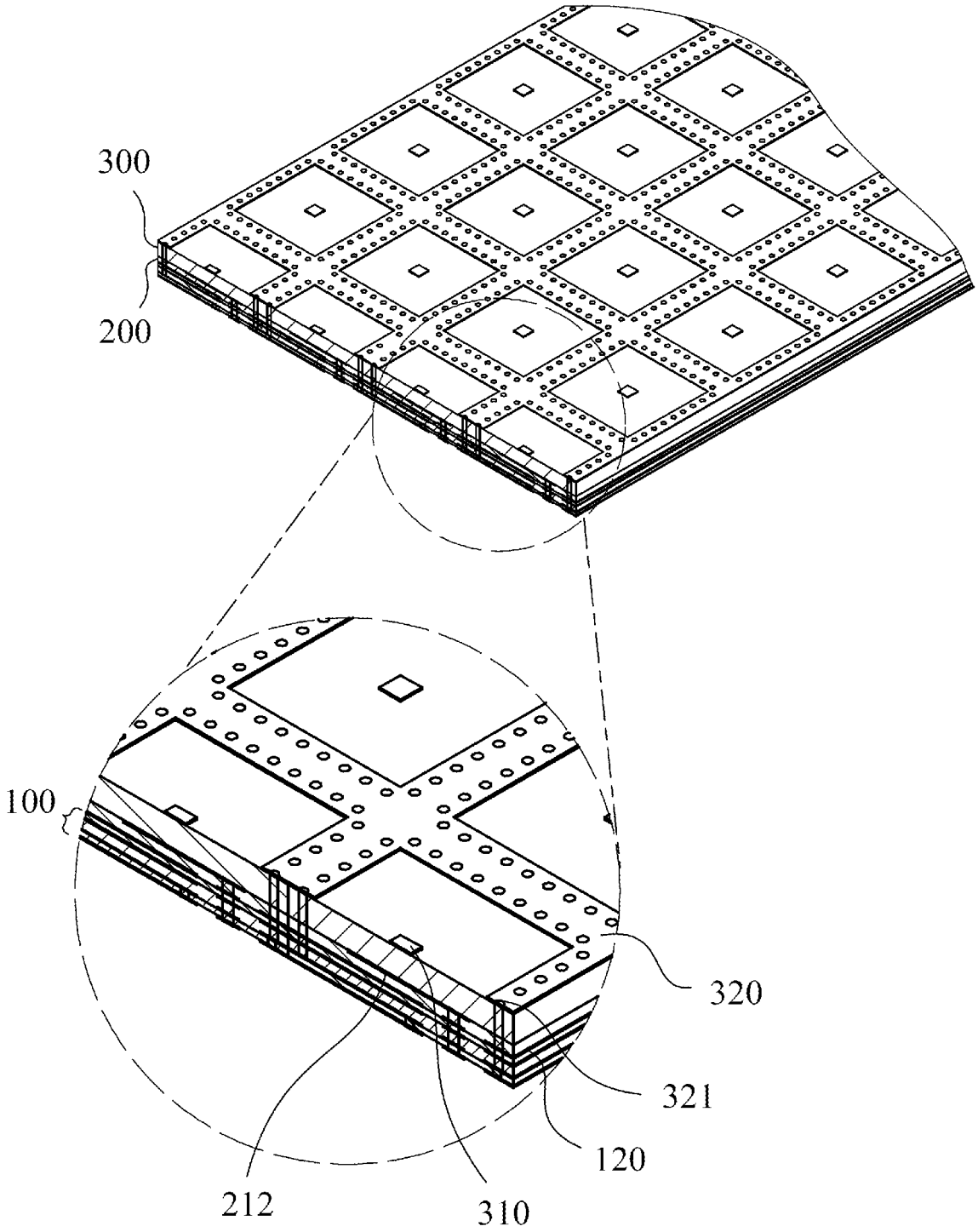
FIG. 6 is a partial section schematic diagram of the embodiment in FIG. 5.

Referring to FIG. 5 and FIG. 6, FIG. 5 shows an exploded schematic diagram of a new dual polarized array waveguide antenna and a signal processing substrate according to another embodiment of the present invention, and FIG. 6 shows a partial section schematic diagram of FIG. 5 according to an embodiment of the present invention. For illustration purposes, the waveguide body 400 is omitted from FIG. 6, and the position of the section line in FIG. 6 is the same as AA' in FIG. 2.

Compared to the embodiments in FIG. 1 to FIG. 4, the embodiment in FIG. 5 and FIG. 6 further includes a heat dissipation lattice layer 320 on the coupling substrate 300. The heat dissipation lattice layer 320 may be configured as surrounding each or some of the coupling pads 310. In the examples shown in FIG. 5 and FIG. 6, each of the coupling pads 310 is surrounded by the heat dissipation lattice layer 320.

The coupling substrate 300 and the antenna array substrate 200 may be provided with a plurality of heat conducting units 321 passing through the coupling substrate 300 and the antenna array substrate 200. The heat conducting units 321 may be coupled to a grounding layer of the signal processing substrate 100. Because grounding paths with electrical conductivity are established by a metal material and the metal material is also heat conductive, heat conduction effects are achieved to provide the antenna array in a dense arrangement with a better heat dissipation solution. The heat conducting units 321 and the heat dissipation lattice layer 320 may also be formed of metal materials or contain metal materials, such that manufacturing of the heat dissipation lattice layer 320 may be completed and the manufacturing of the heat conducting units 321 may be completed in pre-processed vias during the printed circuit board manufacturing process.

The grounding layer 120 of the signal processing substrate 100 is exemplified as being located on the top layer of the signal processing substrate 100 in FIG. 5 and FIG. 6 to further enhance anti-interference ability; however, in other embodiments, the grounding layer 120 may also be located on other layers. The grounding layer 120 located on the top layer of the signal processing substrate 100 has a greater area that allows a greater number of heat conducting units 321 to be configured and hence more heat conducting paths for transmitting heat energy to the heat dissipation lattice layer 320, providing better overall heat dissipation performance for the antenna device.

In conclusion, on the basis of the structural arrangement of the ridges of the waveguide body and the coordination of the antenna array substrate, the new dual polarized array waveguide antenna disclosed according to the embodiments of the present invention provides better waveguide matching, reduces transmission loss, facilitates increasing the bandwidth and providing better beamforming effects. Moreover, by using a heat dissipation lattice layer and a plurality of heat conducting units, the antenna array in a dense arrangement is provided with a better heat dissipation solution.

While the invention has been described by means of specific embodiments, numerous modifications and variations could be made thereto by those skilled in the art without departing from the scope and spirit of the invention set forth in the claims.

What is claimed is:

1. A dual polarized array waveguide antenna, configured above a signal processing substrate, comprising:

an antenna array substrate, comprising a plurality of patches, each of the patches having a first coupling portion and a second coupling portion coupled to the signal processing substrate, the first coupling portion being for transmitting a first electromagnetic signal, the second coupling portion being for transmitting a second electromagnetic signal, polarization directions of the first electromagnetic signal and the second electromagnetic signals being orthogonal;

a coupling substrate, configured above the antenna array substrate, a top surface of the coupling substrate comprising a plurality of coupling pads corresponding to the patches, each of the coupling pads being configured above an intersection area of the first coupling portion and the second coupling portion; and a waveguide body, configured above the coupling substrate, comprising a plurality of waveguide channels passing through the waveguide body and corresponding to the coupling pads, each of the waveguide channels having a first ridge pair and a second ridge pair projecting from wall surfaces, each of the first ridge pair and the second ridge pair having two ridges arranged opposite to each other, the first ridge pair being for transmitting the first electromagnetic signal, the second ridge pair being for transmitting the second electromagnetic signal, each of the first ridge pair and the second ridge pair having, on an upper section of the waveguide channel, an opening portion withdrawn toward the wall surface of the waveguide channel.

2. The dual polarized array waveguide antenna according to claim 1, wherein each of the first ridge pair and the second ridge pair has a tapered front edge portion on a portion other than the opening portion.

3. The dual polarized array waveguide antenna according to claim 1, wherein an axis of the waveguide channel passes through the coupling pad.

4. The dual polarized array waveguide antenna according to claim 1, wherein a vertical depth of the opening portion is less than ⅓ of a vertical depth of the waveguide channel.

5. The dual polarized array waveguide antenna according to claim 4, wherein the opening portion has a step portion near an exit of the waveguide channel, and a vertical depth of the step portion is less than 1/20 of the vertical depth of the opening portion.

6. The dual polarized array waveguide antenna according to claim 1, wherein the coupling pad is a rectangle in shape and comprises a metal material.

7. The dual polarized array waveguide antenna according to claim 1, wherein the coupling pad is a square in shape and comprises a metal material.

8. The dual polarized array waveguide antenna according to claim 1, wherein the patch is an asymmetric cross and comprises a metal material.

9. The dual polarized array waveguide antenna according to claim 1, wherein an area of the coupling pad is less than an area of the intersection area of the first coupling portion and the second coupling portion.

10. The dual polarized array waveguide antenna according to claim 1, wherein the coupling substrate comprises thereon a heat dissipation lattice layer, the heat dissipation lattice layer is coupled to a plurality of heat conducting units passing through the coupling substrate and the antenna array substrate, and each of the heat conducting units is coupled to a grounding layer of the signal processing substrate.

11. The dual polarized array waveguide antenna according to claim 10, wherein each of the coupling pads is surrounded by the heat dissipation lattice layer.

12. The dual polarized array waveguide antenna according to claim 10, wherein each of the waveguide body, the heat dissipation lattice layer and the heat conducting units comprises a metal material.

* * * * *